United States Patent [19]

Kozai et al.

[11] Patent Number: 4,575,970

[45] Date of Patent: Mar. 18, 1986

[54] METAL STRIP EDGE GRINDING APPARATUS

[75] Inventors: Shinji Kozai; Suenobu Shiiba, both of Kobe; Yoshitaka Higashitani, Tokyo, all of Japan

[73] Assignee: Kawasaki Steel Corporation, Kobe, Japan

[21] Appl. No.: 631,989

[22] Filed: Jul. 18, 1984

[30] Foreign Application Priority Data

Sep. 10, 1983 [JP] Japan ..... 58-165883[U]

[51] Int. Cl.[4] ..... B24B 9/04

[52] U.S. Cl. ..... 51/165.92; 51/74 R; 51/165.8

[58] Field of Search ..... 51/74, 78, 165.92, 165.8, 51/126, 354, 2 Q, 2 S, 165.81

[56] References Cited

U.S. PATENT DOCUMENTS 1,255,962 2/1918 Warner ..... 51/100 R 2,001,117 5/1935 Tobias ..... 51/78

2,487,568 11/1949 MacBride ..... 51/126

*Primary Examiner*—Harold D. Whitehead

*Attorney, Agent, or Firm*—Balogh, Osann, Kramer, Dvorak, Genova & Traub

[57] ABSTRACT

An apparatus for grinding edges of running metal strips by a rotating grinding wheel, including a grinding wheel supporting table carrying thereon the grinding wheel and a motor for driving the grinding wheel, and driving means for forward and backward driving the table toward and away from the edges of the metal strips. According to the invention, the apparatus further comprises a spring arranged between the table and the driving means, springs hanging the table from a stationary member, and control means for controlling the driving means in response to vibration component free signals without being annoyed with variation in load current of the motor for driving the grinding wheel, thereby eliminating the uneven grinding due to external disturbance during the running of the metal strip.

1 Claim, 8 Drawing Figures

METAL STRIP EDGE GRINDING APPARATUS

BACKGROUND OF THE INVENTION

1. Field of the Invention

This invention relates to a grinding apparatus for grinding edges of metal strips, and more particularly to a grinding apparatus capable of mitigating uneven grinding due to unavoidable vibration in running of metal strips.

2. Description of the Prior Art

The term "metal strips" as used herein designates mainly band steels but is intended to include steel plates, die steels and the like whose edges are ground by rotating grinding wheels during running of the steels.

FIG. 1 illustrates one example of such a grinding apparatus which has been hitherto used. The grinding apparatus in FIG. 1 comprises a rotating grinding wheel 2 for grinding a metal strip 1, a motor 3 for driving the grinding wheel 2, a base or table 4 for supporting the grinding wheel 2, driving means 5 for forward and backward the table 4 toward and away from the edge of the strip, consisting, in this example, of a feeding screw, a motor 6 for rotatively driving the feeding screw and a nut threadedly engaged on the feeding screw and connected to the table 4, a load current detector 7 for the grinding wheel driving motor 3, and a constant-current control unit 8. A reference numeral 9 denotes a set value signal.

The FIG. 1 shows the apparatus for grinding by the rotating grinding wheel 2 an edge of the metal strip 1 running in a direction shown by an arrow $\alpha$. The grinding power acting upon the grinding wheel 2 is identified with the load current of the grinding wheel driving motor 3.

In actual grinding, the table driving motor 6 is energized in a normal or reverse direction by the constant-current control unit 8 to move the table 4 toward and away from the edge of the metal strip 1 so as to bring the rotating grinding wheel 2 into contact with the edge of the metal strip in a manner the load current of the grinding wheel driving motor 3 is kept constant.

However, the metal strip in running is generally subjected to vibrations in longitudinal, traverse and vertical directions as shown by double-headed arrows in FIG. 1 to cause violent variation in load current of the grinding wheel driving motor 3. Accordingly, even if the grinding wheel supporting table 4 is operated so as to be advanced or retracted in response to the variation in load current of the grinding wheel driving motor 3 in the manner as above described, it does not match the great variation in load current resulting in an insufficient grinding power control.

As can be seen from FIGS. 2*a*, 2*b* and 2*c* which compare the load currents of the grinding wheel driving motor with respect to effect by forward and backward control of the grinding wheel supporting table, the constant-current control does not achieve its expected result. The edge of the metal strip is therefore unevenly ground to lower its worth as a product.

SUMMARY OF THE INVENTION

It is a primary object of the invention to provide an improved a metal strip edge grinding apparatus which eliminates the disadvantages of the prior art.

It is another object of the invention to provide a grinding apparatus for grinding edges of metal strips to eliminate uneven grinding by controlling grinding power at substantially constant with high accuracy, thereby improving product worth of the metal strips.

In order to achieve these objects, the apparatus for grinding edges of running metal strips by a rotating grinding wheel, including a grinding wheel supporting table carrying thereon said grinding wheel and a motor for driving the grinding wheel, and driving means for forward and backward driving said table toward and away from the edges of the metal strips according to the invention comprises resiliently urging means arranged between said table and said driving means.

In preferred embodiments of the invention, the resiliently urging means is a spring and the table is hanged by springs from a stationary member.

In the most preferred embodiment of the invention, the apparatus comprises a vibration frequency eliminating circuit for receiving load current signals, cutting off vibration components of the load current signal and generating signals representative of only load current for grinding for controlling the driving means for forward and backward driving the table.

In order that the invention may be more clearly understood, preferred embodiments will be described, by way of example, with reference to the accompanying drawings.

DETAILED DESCRIPTION OF THE PREFERRED EMBODIMENT

In order to realize the high accuracy constant-current control of a grinding wheel driving motor 3 to eliminate the uneven grinding of steel strips, it is required to avoid the rapid variation in the load current of the grinding wheel driving motor. For this purpose, it is necessary to eliminate the variation in the load current by bringing the rotating grinding wheel into light contact with edges of the strips and removing vibration components of the load current of the grinding wheel driving motor, even if the physical vibration of the metal strip cannot be avoided.

Figure 1:
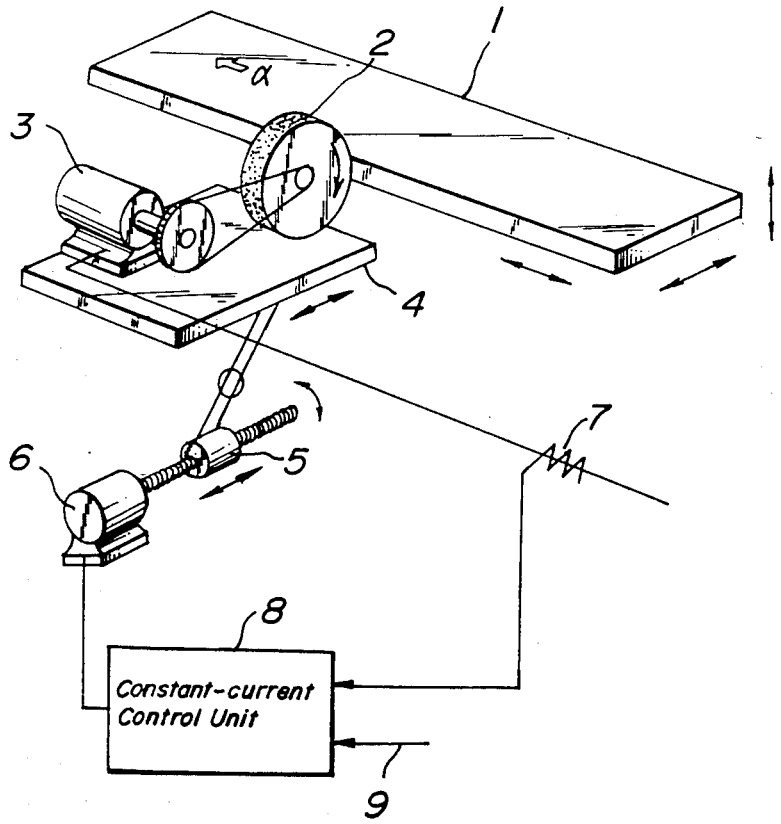
FIG. 1 PRIOR ART
FIG. 1 is a perspective view of a prior art apparatus for grinding edges of metal strips.
Figure 3:
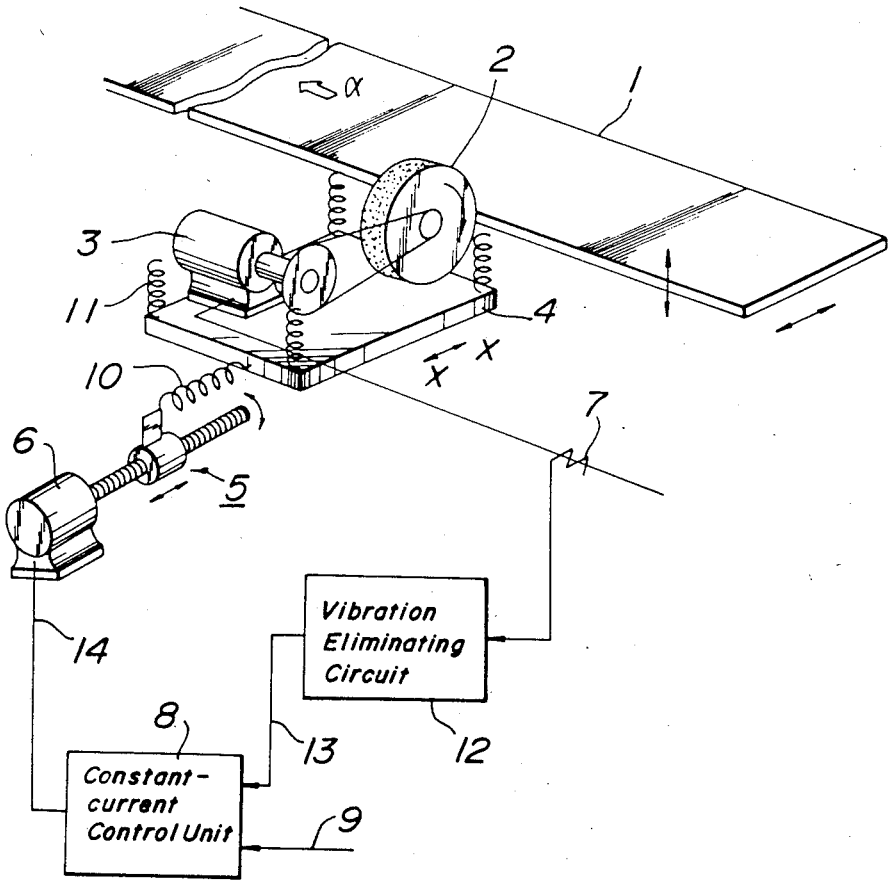
FIG. 3 is a perspective view of one embodiment of the metal strip edge grinding apparatus according to the invention.

FIG. 3 illustrates a preferred embodiment of the grinding apparatus according to the invention, wherein like parts have been designated by the same reference numerals as in FIG. 1. The apparatus in FIG. 3 comprises a constant-current control unit 8 which detects the load current of a grinding wheel driving motor 3 arranged on a grinding wheel supporting base or table 4 adapted to urge a rotating grinding wheel 2 against a metal strip 1 and compares the detected value with a set value, according to which compared result the table 4 is moved forward or backward to change the urging degree of the rotating grinding wheel 2 against the metal strip 1.

In more detail, as shown in FIG. 3, during continuous running of the metal strip 1 in a direction shown by an arrow $\alpha$ an edge of the metal strip 1 is ground by the rotating grinding wheel 2 driven through a V-belt by the grinding wheel driving motor 3. The rotating grinding wheel 2 and the grinding wheel driving motor 3 are located on the grinding wheel supporting table 4 which is movable toward and away from the edge of the metal strip 1. According to the invention, in order to bring the grinding wheel 2 into light or resilient contact with the edge of the metal strip 1, an urging spring 10 is arranged between the table 4 and driving means 5 (a nut of the driving means in this embodiment) and the table 4 is hanged or suspended by hanging springs 11 from a stationary member (not shown).

In this manner according to the invention, the spring 10 bringing the grinding wheel 2 into light contact with the edge of the metal strip 1 serves to absorb the vibration of the metal strip 1 as a cushion so as to greatly reduce the variation in load current for grinding.

In this case, one end of the urging spring 10 is fixed to the driving means 5 and the other end of the spring 10 is in contact with the grinding wheel supporting table 4 so that when the motor 6 of the driving means 5 is energized, the grinding wheel supporting table 4 is moved forward or backward lightly or resiliently through the displacement of the spring 10 in elongation or contraction. The variation in load current of the grinding wheel driving motor 3 is reduced by the light contact of the grinding wheel with the edge of the metal strip 1. In addition, the variation in load current is further reduced by passing the detected signal from a load current detector 7 through a vibration frequency eliminating circuit 12 which is a known filter circuit including a variable resistance and a variable condenser capable of cutting off the frequencies within a particular range (grinding vibration frequencies).

In other words, the detected load current of the grinding wheel driving motor 3 includes natural vibrations of the metal strip 1 and the grinding wheel operating table 4 in addition to the inherent load current for grinding. Accordingly, the load current of the grinding wheel driving motor 3 is converted in the detector 7 into voltage signal which passes through the vibration frequency eliminating circuit 12 to cut off extra frequency components so as to form a detected signal 13 representative of the inherent load current for grinding which is then transmitted into a constant-current control unit 8.

The vibration frequency eliminating circuit is a well known device. For example, it is manufactured by the Omika Factory of Hitachi, Ltd., in Japan. It is described in a publication for a seminar of practical exercise held by the Omika Factory of Hitachi, Ltd., in April, 1975 (The title of this particular publication is "Text for Seminar of Practical Exercise for Electronically Controlled Equipment"). The purpose of such seminar is to guide general users to correctly use such devices. The inventors used the filter circuit disclosed in FIG. 19 of this publication for the vibration frequency eliminating circuit disclosed herein.

The constant-current control unit 8 compares the detected signal 13 with a set value signal 9 for the grinding current and generates in response to the compared result a control signal 14 for driving the motor 6 for the table 4 in a normal or reverse direction.

Figure 2A:
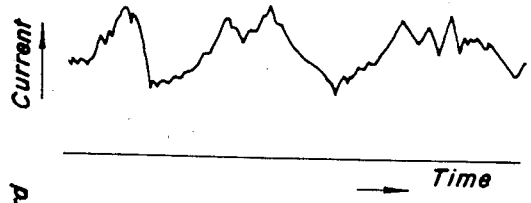
FIG 2a PRIOR ART
FIGS. 2*a*, 2*b* and 2*c* are graphs illustrating current wave forms affected by forward and backward movement of a table carrying a grinding wheel in the prior art.
Figure 2B:
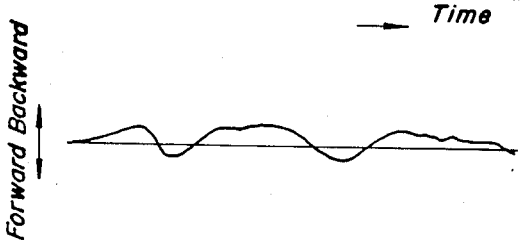
FIG 2b PRIOR ART
Figure 2C:
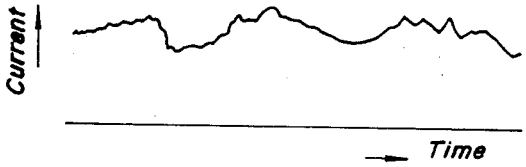
FIG 2c PRIOR ART
Figures 4A, 4B, 4C:
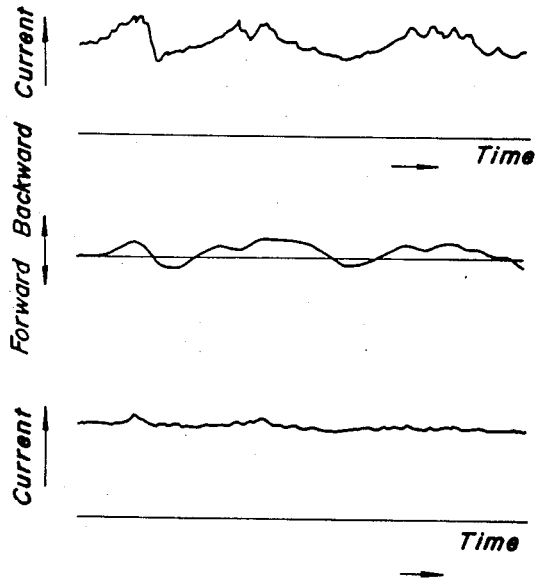
FIGS. 4*a*, 4*b* and 4*c* are graphs of current wave forms illustrating the effect of the control according to the invention.

By eliminating the vibration frequencies as above described, the constant-current control with high accuracy ($\pm 5\%$) can be realized even if the edge of a metal strip 1 is ground under violent vibration condition. FIGS. 4*a*, 4*b* and 4*c* illustrate the effect of the constant current control in the same fashion as in FIGS. 2*a*, 2*b* and 2*c*. It is clearly evident that the variation in load current of the grinding wheel driving motor 3 can be reduced according to the invention.

As can be seen from the above description, according to the invention the variation in load current of a motor for driving a grinding wheel for grinding edges of running metal strips due to external disturbance can be advantageously avoided to eliminate the uneven grinding due to the variation in load current.

It is further understood by those skilled in the art that the foregoing description is that of preferred embodiments of the disclosed apparatus and that various changes and modifications may be made in the invention without departing from the spirit and scope thereof.

What is claimed is:

1. An apparatus for grinding edges of running metal strips by a rotating grinding wheel comprising a grinding wheel supporting table carrying thereon said grinding wheel, a motor for driving said grinding wheel mounted on said table, driving means for forward and backward driving said table toward and away from the edges of the metal strips, resiliently urging means arranged between said table and said driving means, a plurality of springs for suspending said table and cooperating with said resiliently urging means to bring said grinding wheel into resilient contact with the edges of the metal strips, load current detecting means for detecting a load current of said motor for driving said grinding wheel, a vibration frequency eliminating circuit for receiving load current signals from said load current detecting means, cutting off vibration components of the received signals, and generating signals representative of only load current for grinding, and a constant current control unit for receiving signals representative of only load current for grinding, comparing the received signal with a set value signal for grinding current and ge nerating in response to a compared result a control signal for controlling said driving means for forward and backward driving said table so as to substantially reduce the variation in load current of said motor for driving said grinding wheel and substantially eliminate uneven grinding of the edges of the metal strips, said resiliently urging means comprising a spring and said driving means comprising a feeding screw, a motor for rotatively driving the feeding screw and a nut threadedly engaged with the feeding screw and connected to said table through said spring of said resiliently urging means, said spring having one end thereof connected to said table and the other end thereof connected to the nut.

* * * * *